US007740050B2

(12) United States Patent
Cheng et al.

(10) Patent No.: US 7,740,050 B2
(45) Date of Patent: Jun. 22, 2010

(54) MOLD FOR MANUFACTURING HEAT DISSIPATION APPARATUS

(75) Inventors: Nien-Tien Cheng, Taipei Hsien (TW); Chen-Shen Lin, Taipei Hsien (TW); Zhi-Ming Liu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 297 days.

(21) Appl. No.: 11/762,974

(22) Filed: Jun. 14, 2007

(65) Prior Publication Data

US 2008/0156452 A1 Jul. 3, 2008

(30) Foreign Application Priority Data

Dec. 29, 2006 (CN) ..... 2006 1 0064608

(51) Int. Cl.
*B22C 9/00* (2006.01)
*B22D 29/00* (2006.01)

(52) U.S. Cl. ..... 164/340; 164/347; 164/132

(58) Field of Classification Search ..... 164/109, 164/112, 137, 288, 332–334, 339–342; 249/175–186; 29/890.03, 890.032
See application file for complete search history.

(56) References Cited

U.S. PATENT DOCUMENTS 5,562,146 A * 10/1996 Harmon et al. ..... 164/112
6,305,924 B1 10/2001 Krinke et al.
6,516,867 B1 2/2003 Ootori et al.
6,751,859 B2 * 6/2004 Farnworth et al. ..... 29/842

FOREIGN PATENT DOCUMENTS

CN 1321335 A 11/2001
JP 2000-263210 A 9/2000
JP 2004243392 A * 9/2004

OTHER PUBLICATIONS

Chun-Rong Lai, Bing Wang, "Structure Analysis of Precision Casting mold for Heat Sink and Method for Making Sand Shell Core" in "Special Casting & Nonferrous Alloys" (pp. 6 and 28-29) (Sixth Issue in 1999), China.

* cited by examiner

*Primary Examiner*—Jessica L. Ward
*Assistant Examiner*—Kevin E Yoon
(74) *Attorney, Agent, or Firm*—Jeffrey T. Knapp

(57) ABSTRACT

A mold (200) for manufacturing a heat dissipation apparatus (10) includes a movable mold (20) and a fixed mold (30) covering the movable mold. The heat dissipation apparatus includes a plurality of fins (12). One of the movable mold and the fixed mold includes an insert group (50). The insert group includes a plurality of separated inserts (51) stacked together. A plurality of compartments (513) are formed between adjacent inserts of the insert group for forming the fins of the heat dissipation apparatus when molten metal is injected into the mold.

14 Claims, 9 Drawing Sheets

MOLD FOR MANUFACTURING HEAT DISSIPATION APPARATUS

BACKGROUND OF THE INVENTION

1. Field of the Invention

The present invention relates to molds and methods for manufacturing heat dissipation apparatuses, and more particularly to a mold for manufacturing a heat dissipation apparatus having large heat dissipating area.

2. Description of Related Art

It is well known that thermal modules are traditionally used in micro-electronics to help transfer heat from heat generating electronic components mounted on a printed circuit board. A typical thermal module includes a base plate, a centrifugal blower mounted to the base plate, a fin assembly located at an air outlet of the centrifugal blower and a heat pipe connecting the heat generating electronic component with the fin assembly to transfer heat therebetween.

In the thermal module, the base plate, a housing of the centrifugal blower and the fin assembly are formed together into a combination. The fin assembly is formed by a piece of insert arranged in a mold having cavities for forming the base plate and the housing of the centrifugal blower. The insert defines a plurality of concave cavities for forming fins of the fin assembly. During manufacturing of such a combination, there is always air retained in the concave cavities of the insert which causes bubbles to form in the fins of the fin assembly after molten metal is cooled. The bubbles result in residual stresses in the fins and thus decrease mechanical strength of the fins. The fins, which do not have sufficient strength, may be damaged in parting mold operation. Therefore, the fins need to be thicker to solve these problems. However, thicker fins are not preferable in view of heat dissipation effectiveness. Furthermore, the entire insert needs to be replaced when some of the concave cavities are damaged due to the damage of the fins without sufficient strength. This increases the maintenance cost of the mold. Thus, it is necessary to provide a mold, which has a lower maintenance cost and can manufacture a thermal module having thinner fins.

SUMMARY OF THE INVENTION

The present invention relates, in one aspect, to a mold for manufacturing a heat dissipation apparatus. The mold includes a movable mold and a fixed mold covering the movable mold. The heat dissipation apparatus includes a plurality of fins. One of the movable mold and the fixed mold includes an insert group. The insert group includes a plurality of stacked inserts. A plurality of compartments are formed between adjacent inserts of the insert group for forming the fins of the heat dissipation apparatus.

The present invention relates, in another aspect, to a method for manufacturing a heat dissipation apparatus. A method for manufacturing a heat dissipation apparatus includes: providing a mold including a movable mold and a fixed mold; assembling the movable mold and the fixed mold together; injecting molten metal into the mold; cooling the molten metal to obtain a rough cast; separating the movable mold from the fixed mold; pushing the rough cast out of the mold and dressing (i.e., removing extraneous parts such as the part corresponding to a runner of the mold through, for example, chiseling) the rough cast to obtain the heat dissipation apparatus. One of the movable mold and the fixed mold defines a chamber for receiving a mold core therein. The mold core defines an opening for receiving an insert group therein. The insert group includes a plurality of stacked inserts and defines a plurality of compartments formed between adjacent inserts.

Other advantages and novel features of the present invention will become more apparent from the following detailed description of preferred embodiments when taken in conjunction with the accompanying drawings, in which:

DETAILED DESCRIPTION OF THE INVENTION

Figure 1:
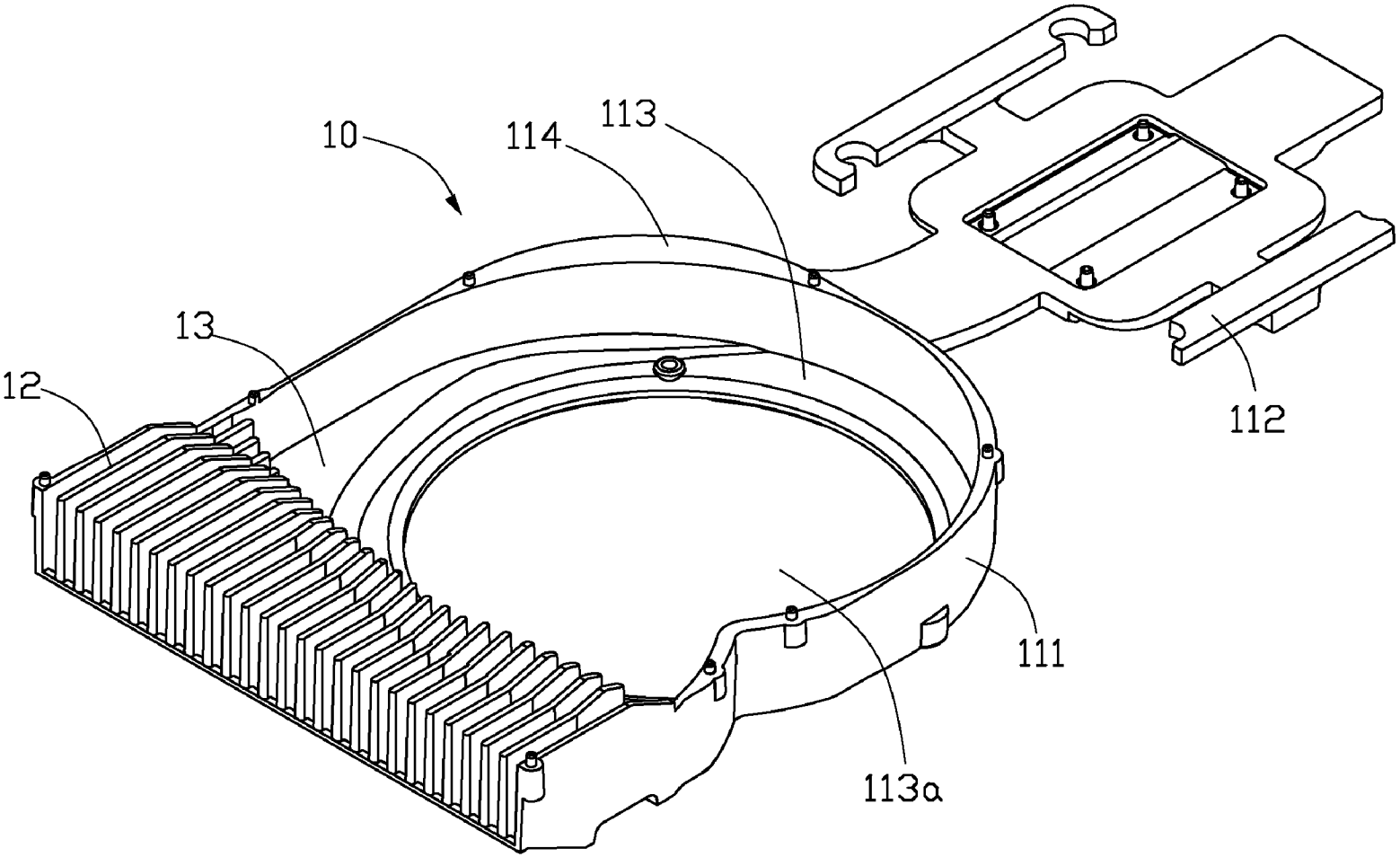
FIG. 1 is an isometric view of a heat dissipation apparatus in accordance with a preferred embodiment of the present invention.

Referring to FIG. 1, a heat dissipation apparatus 10 formed in accordance with a mold 200 (FIG. 2) of the present invention is shown. The heat dissipation apparatus 10 is used in a laptop computer for dissipating heat generated by heat generating electronic components such as a CPU (central processing unit), or VGA (video graphics accelerator) cards. The heat dissipation apparatus 10 can also be used in an LCD (liquid crystal display) television, or a DVD (digital video disc) player for dissipating heat generated by heat generating electronic components disposed therein.

The heat dissipation apparatus 10 is made of highly thermally conductive material such as aluminum, aluminum alloy, copper, or copper alloy. The heat dissipation apparatus 10 includes a housing 111 of a centrifugal blower, a base plate 112, and a plurality of fins 12. The housing 111 of the centrifugal blower includes a base wall 113 and a U-shaped sidewall 114 extending upwardly from a periphery of the base wall 113. The base wall 113 defines a round air inlet 113*a* therein, whilst the sidewall 114 defines an air outlet 13 therein. The base plate 112 extends from the housing 111 at a side opposite to the air outlet 13 of the centrifugal blower and is integrally formed with the housing 111 from a single piece. The fins 12 are located at the air outlet 13 of the housing 111 and integrally molded with the housing 111 from a single piece.

Figure 2:
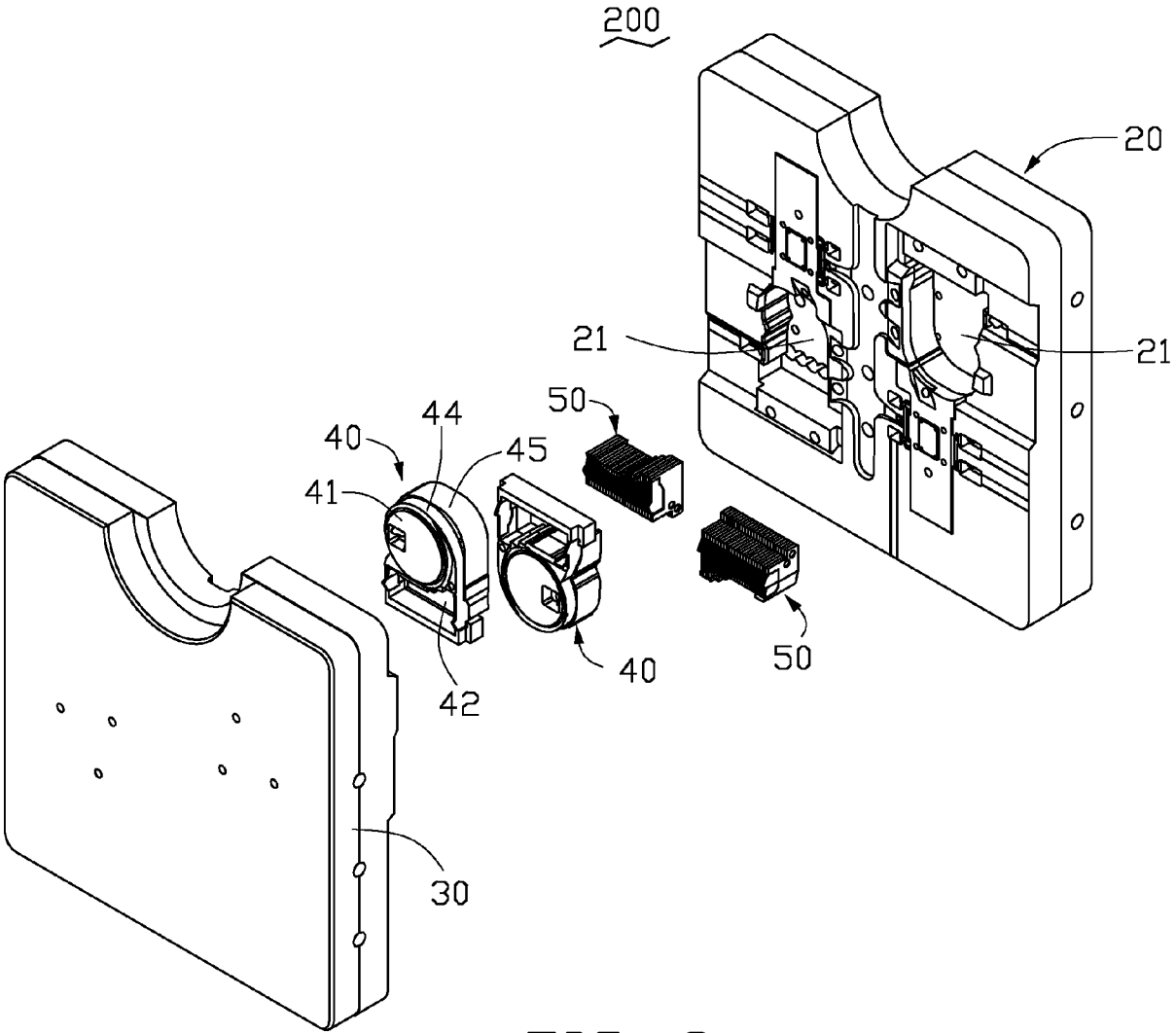
FIG. 2 is an exploded, isometric view of a mold for manufacturing the heat dissipation apparatus of FIG. 1.

Referring to FIG. 2, a mold 200 for manufacturing the heat dissipation apparatus 10 of FIG. 1 is shown. The mold 200 includes a fixed mold 30 and a movable mold 20 covering the fixed mold 30. The mold 200 defines two mold cavities (not labeled) therein for forming two heat dissipation apparatus 10 at one time.

The movable mold 20 and the fixed mold 30 are rectangular shaped in profile. Two chambers 21 are defined in the movable mold 20, receiving two solid mold cores 40 therein. The mold core 40 defines an opening 42 receiving an insert group 50 therein, for forming the fins 12 of the heat dissipation apparatus 10.

Figure 4:
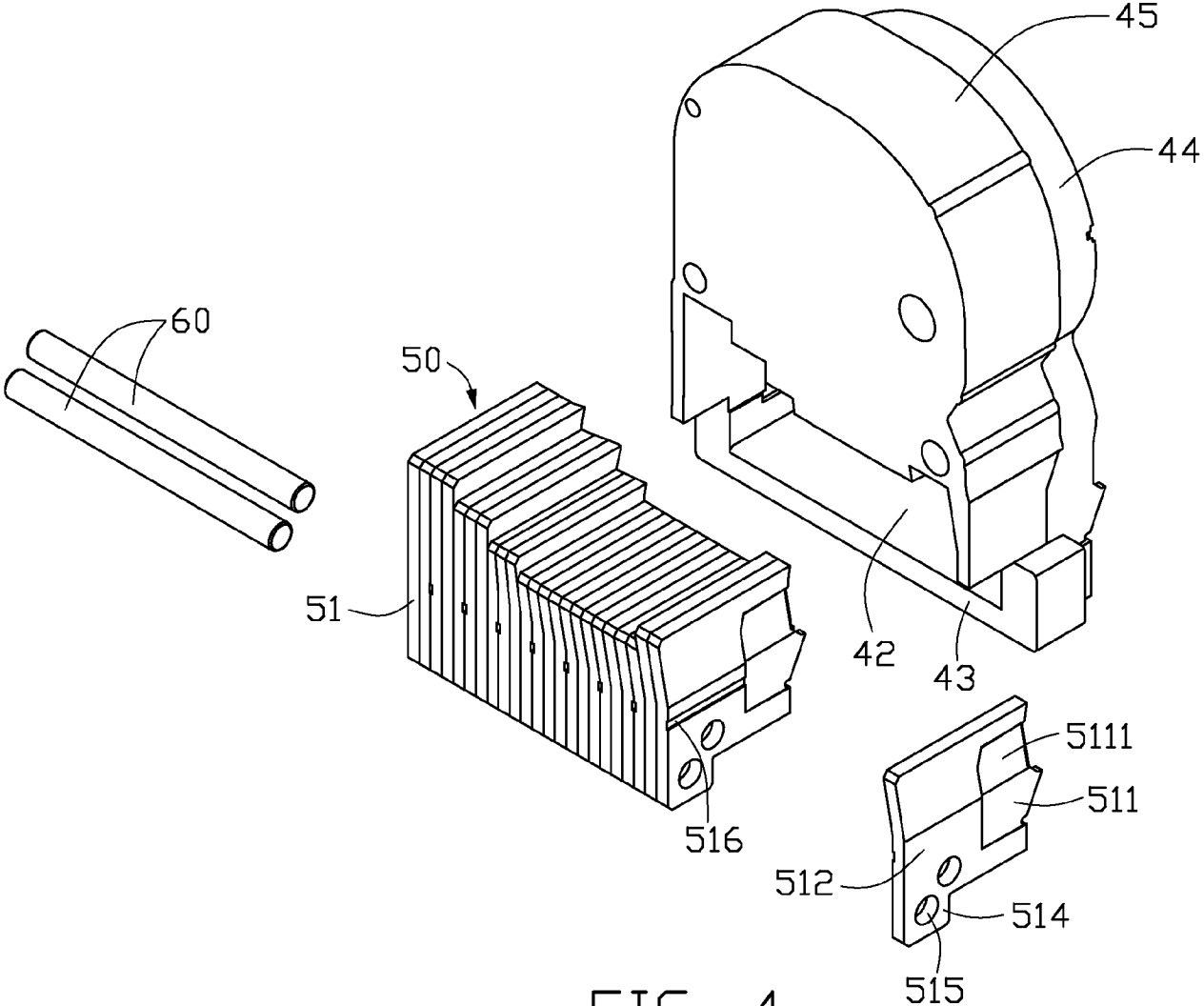
FIG. 4 is an exploded, isometric view of the mold core and an insert group of the mold of FIG. 2.
Figure 5:
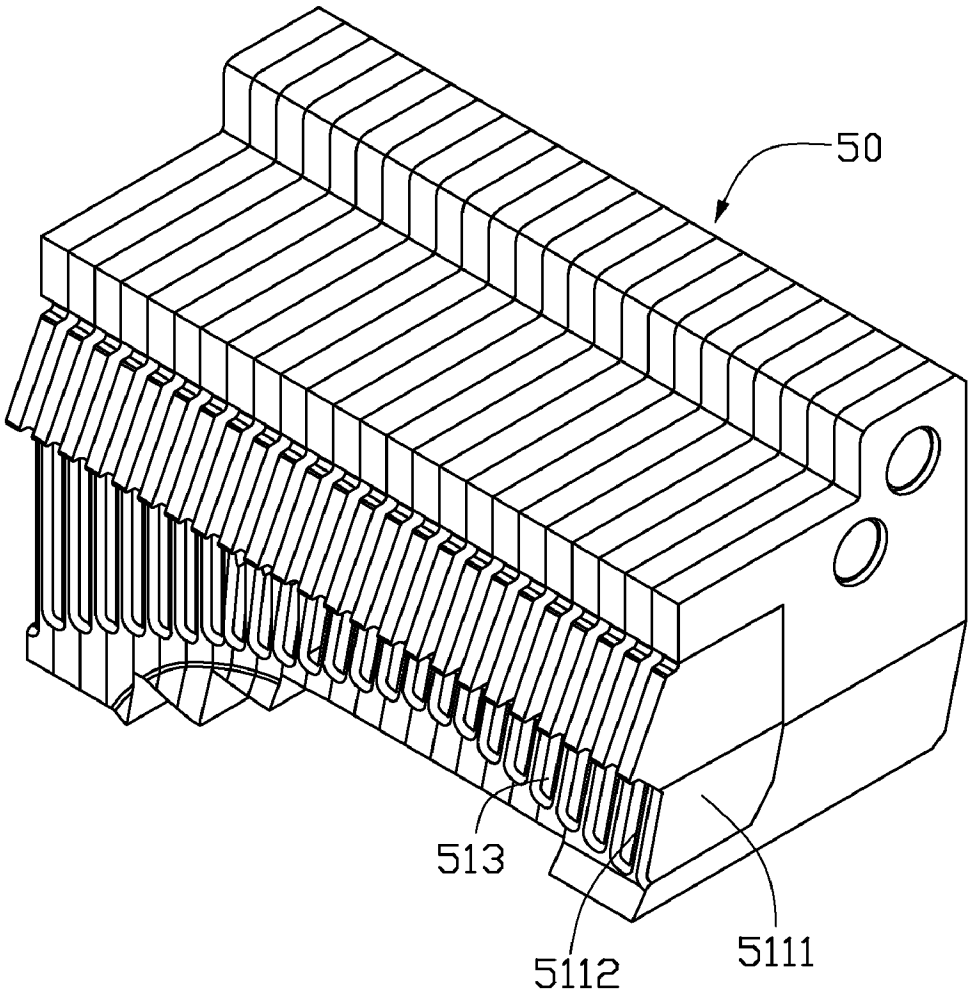
FIG. 5 is an isometric view of the insert group of FIG. 4.

Referring to FIGS. 4 and 5, the insert group 50 includes a plurality of inserts 51 which are stacked together for forming the fins 12 of the heat dissipation apparatus 10. Each of the inserts 51 includes a top portion 511 and a bottom portion 512 on an opposite side of the insert 51 to the top portion 511. The insert 51 defines two concave cavities 5111, 5112 at two opposing sides of the top portion 511. Facing concave cavities 5111, 5112 of two adjacent inserts 51 cooperatively define a compartment 513 for forming the fin 12. A block 514 is formed at a right side of the bottom portion 512 of each of the inserts 51. The mold core 40 has a carrier 43 corresponding to the blocks 514 of the inserts 51. When the insert group 50 is received in the opening 42 of the mold core 40, the blocks 514 of the fins 12 engage with the carrier 43 of the mold core 40 so as to hold the insert group 50 in the mold core 40. The right side of the bottom portion 512 of the insert 51 defines two through holes 515 therein. Two locating pins 60 extend through the through holes 515 of the inserts 51 joining the inserts 51 together to obtain the insert group 50. A plurality of slots 516 are defined in facing sides of the bottom portions 512 of some of adjacent inserts 51. The slot 516 extends through the bottom portion 512 of the insert 51 along a longitudinal direction of the insert 51 and communicates the compartment 513 of the top portions 511 of two adjacent inserts 51 with the chamber 21 of the movable mold 20. A plurality of ejecting pins (not shown) are received in the slots 516 so as to push a rough cast 70 (FIG. 9) of the heat dissipation apparatus 10 out of the movable mold 20 after the rough cast 70 (FIG. 9) is solidified in the mold 200 and the mold 200 is opened.

Figure 3:
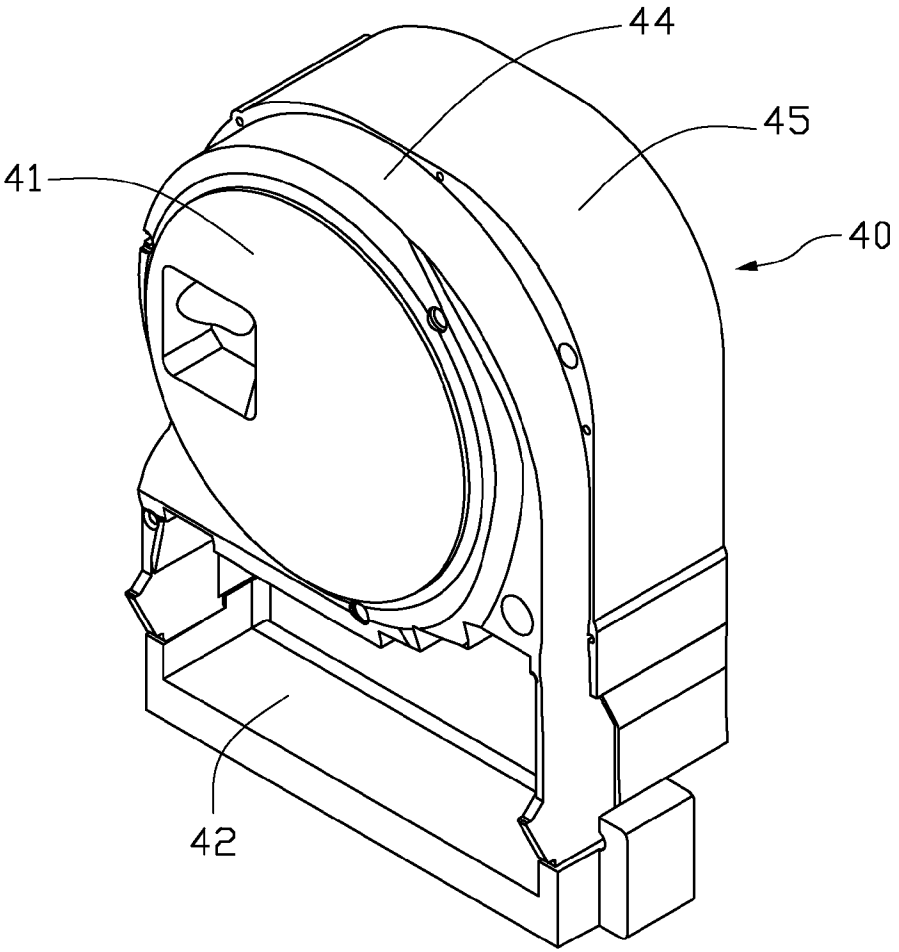
FIG. 3 is an isometric view of a mold core of the mold of FIG. 2.

Referring to FIG. 3, each of the mold cores 40 includes a first portion 45 interferentially received in a bottom of the chamber 21, a second portion 44 extending upwardly from the first portion 45 and a third portion 41 extending upwardly from the second portion 44. An outer surface of the first portion 45 of the mold core 40 and an inner surface of the chamber 21 have configurations substantially similar to an outer surface of the sidewall 114 of the housing 111. An outer surface of the second portion 44 of the mold core 40 has a configuration substantially similar to an inner surface of the sidewall 114 of the housing 111. An outer surface of the third portion 41 has a configuration substantially similar to the air inlet 113*a* of the base wall 113 of the housing 111. A first cavity 231 (FIG. 6) is formed between a top surface of the first portion 45 of the mold core 40, the outer surface of the second portion 44 of the mold core 40 and a top of the inner surface of the chamber 21, for forming the sidewall 114 of the centrifugal blower.

The fixed mold 30 defines two second cavities 33 (FIG. 7) therein. The second cavity 33 has a configuration substantially similar to a combination of the base wall 113 of the centrifugal blower and the base plate 112 of the heat dissipation apparatus 10, for forming the base wall 113 of the centrifugal blower and the base plate 112 of the heat dissipation apparatus 10. When the movable mold 20 covers the fixed mold 30, the first and the second cavities 231, 33 cooperatively form the mold cavities of the mold 200, and the third portion 41 of the mold core 40 extends into the second cavity 33 of the fixed mold 30, thus forming the air inlet 113*a* of the centrifugal blower.

Figure 6:
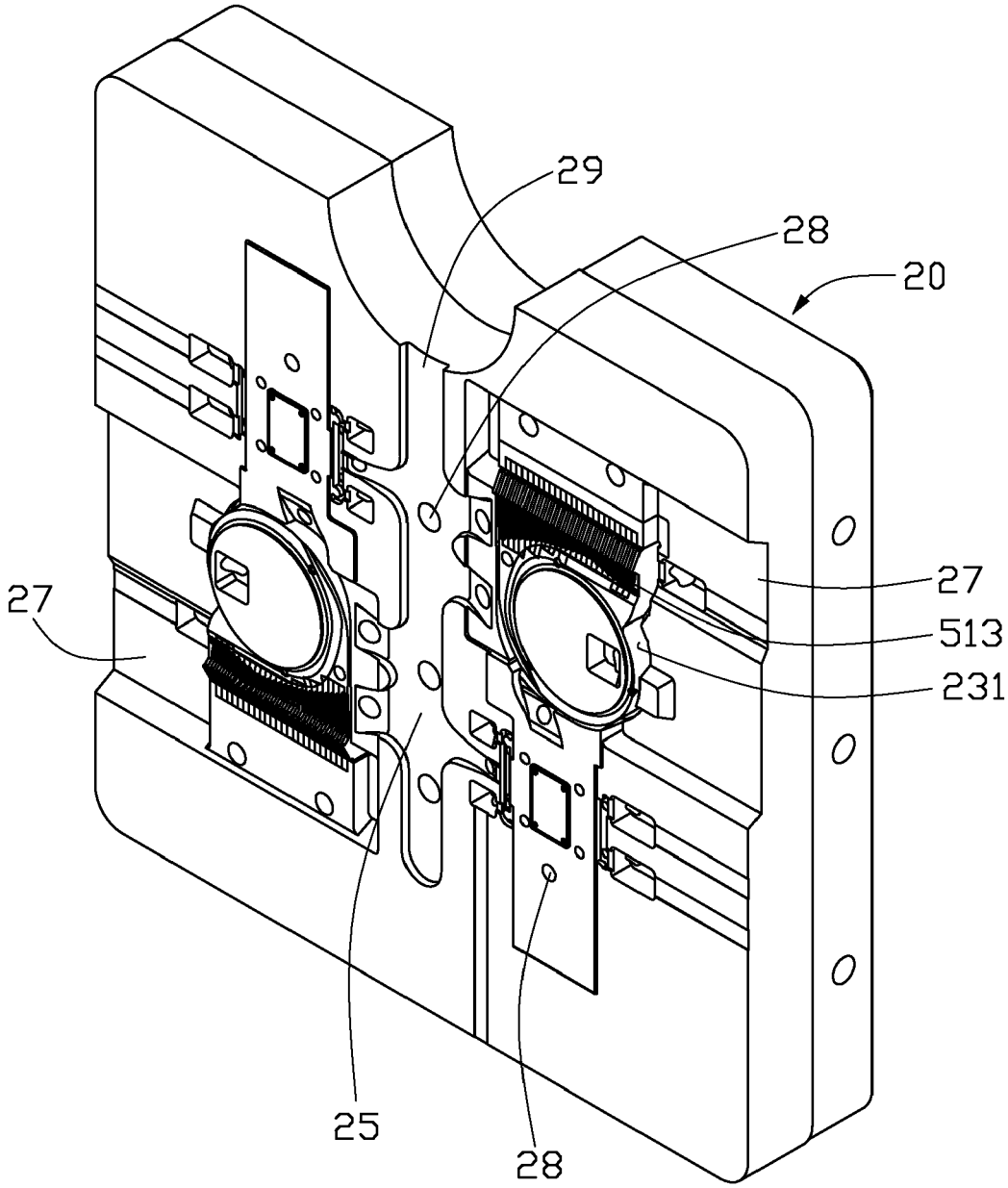
FIG. 6 is an assembled view of the mold core, the insert group and a movable mold of the mold of FIG. 2.
Figure 7:
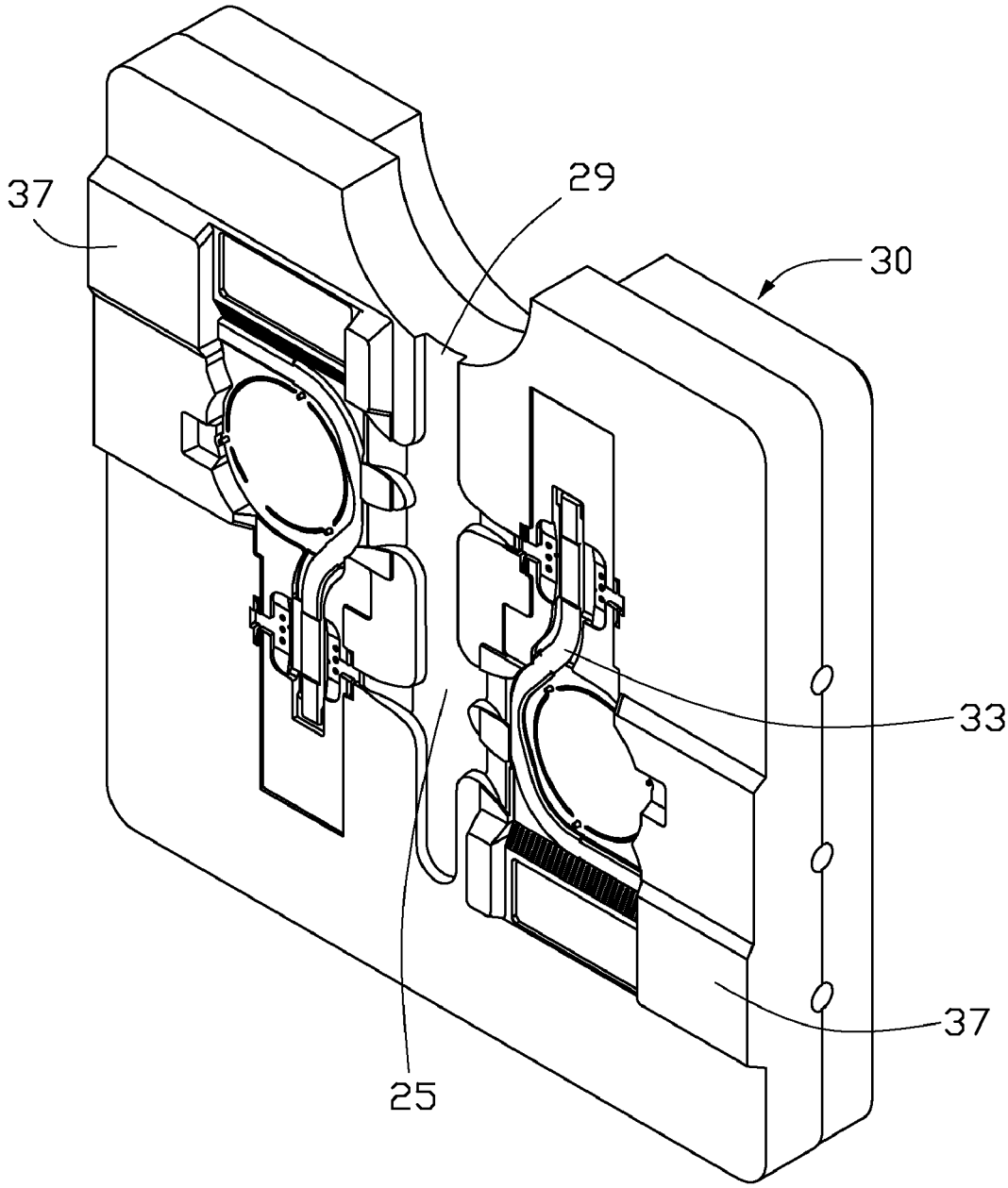
FIG. 7 is an isometric view of a fixed mold of the mold of FIG. 2.

Referring to FIGS. 6 and 7, the mold 200 defines a runner 25 between the two mold cavities so as to communicate the mold cavities into a single cavity. In order to make sure that the movable mold 20 accurately covers the fixed mold 30, the movable mold 20 defines two indents 27 at two diagonally opposite corners thereof, and the fixed mold 30 projects two protrusions 37 into the indents 27 of the movable mold 20. The movable mold 20 further defines a plurality of bores 28 therein so that a plurality of pins (not shown) extend through the bores 28 to push the heat dissipation apparatus 10 out of the movable mold 20.

Figure 8:
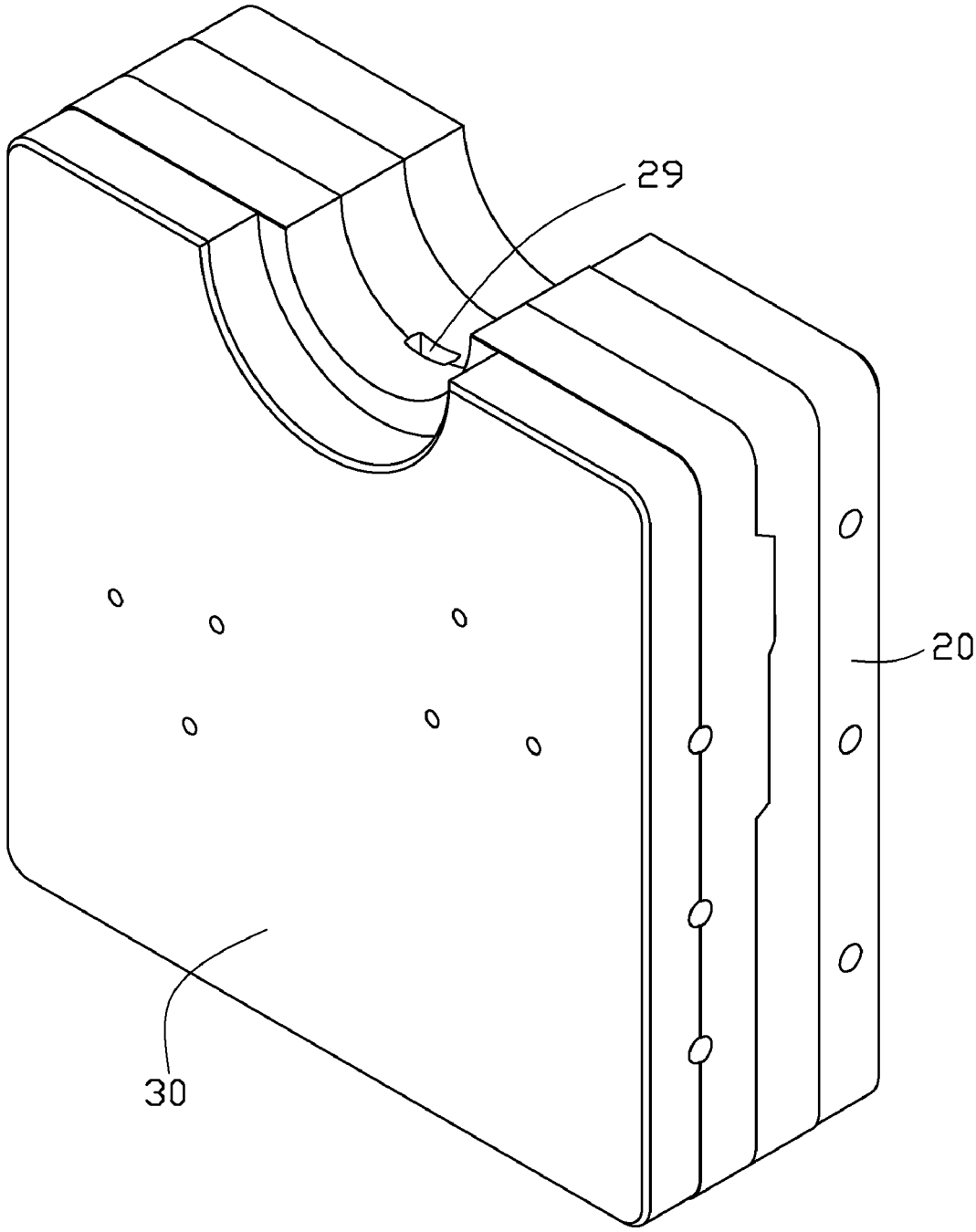
FIG. 8 is an assembled view of the mold of FIG. 2.
Figure 9:
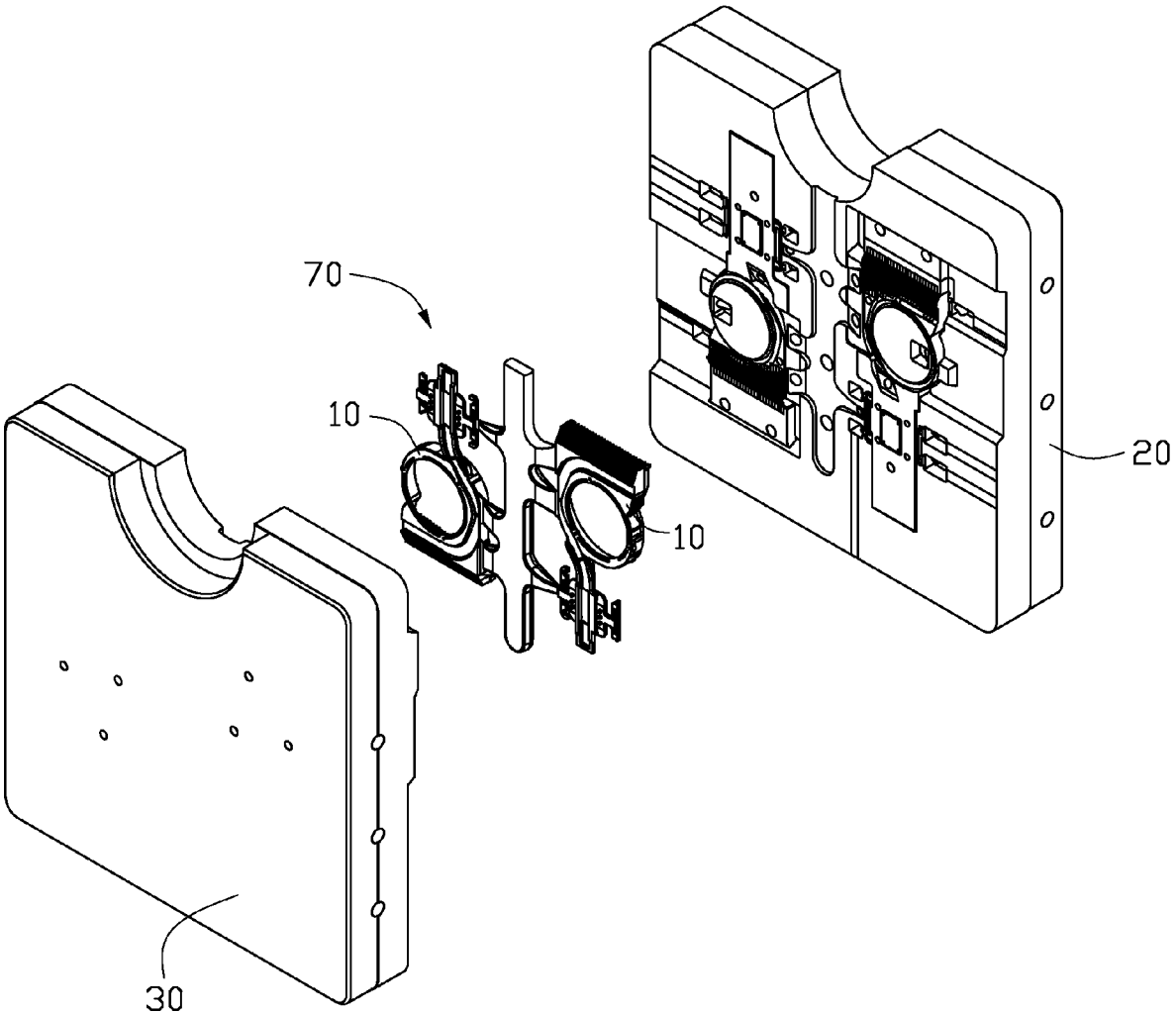
FIG. 9 is an isometric view of a rough cast manufactured by the mold of FIG. 2.

Referring to FIGS. 8 and 9, the manufacturing of the heat dissipation apparatus 10 includes the steps of: Mounting the movable mold 20 and the fixed mold 30 to a die casting machine (not shown) in a separate manner; Spraying a layer of lubricant on inner surfaces of the mold cavities; Bringing the movable mold 20 and the fixed mold 30 together; Injecting molten metal into the mold cavities of the mold 200 via a sprue 29 and the runner 25; Cooling the molten metal to obtain a rough cast 70; Separating the movable mold 20 from the fixed mold 30; Pushing the rough cast 70 out of the first cavity 231 of the movable mold 20; Dressing (i.e., removing extraneous parts such as the parts corresponding to the runner 25 and the sprue 29 by, for example, chiseling) the rough cast 70 and dividing the rough cast 70 into two heat dissipation apparatuses 10.

In the present mold 200, the inserts 51 are stacked together into a group to form the fins 12. Therefore, air in the compartments 513 can leak from clearances formed between the adjacent inserts 51. Thus, the molten metal can fully be injected into the compartments 513 of the mold 200, which increases the mechanical strength of the fins 12 and therefore benefits formation of thinner fins 12. A thickness of the fins 12 formed by the present mold 200 can be about 0.6 mm, and a distance between the adjacent fins 12 can be about 1 mm. However, a thickness of the fins formed by the conventional mold should be more than about 1 mm, and a distance between the adjacent conventional fins should be more than about 1.5 mm. Therefore, the heat dissipating area of the fins 12 of the present heat dissipation apparatus 10 is greater than that of the fins formed by the conventional mold. In addition, the ejecting pins are received in the slots 516 of the inserts 51 and push the fins 12 to move away from the movable mold 20. The fins 12 can be pushed out of the movable mold 20 under a smaller draft taper. Moreover, damaged inserts 51 can be replaced without changing the entire insert group 50, which decreases maintenance cost of the mold 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mold for manufacturing at least a heat dissipation apparatus with a plurality of fins, comprising:

a movable mold; and a fixed mold covering the movable mold;

wherein one of the movable mold and the fixed mold comprises an insert group which comprises a plurality of separably stacked inserts, wherein a plurality of compartments are defined between adjacent inserts of the insert group for forming the fins of the at least a heat dissipation apparatus; and wherein each of the inserts has two concave cavities defined in two opposing sides thereof, the compartments each being defined by two facing concave cavities of the adjacent inserts.

2. The mold as described in claim 1, wherein each of the inserts comprises a top portion and a bottom portion, the concave cavities being formed in the top portion, the bottom portions of some of the inserts defining a plurality of slots therein, the slots communicating the concave cavities with a chamber of the mold and receiving a plurality of ejecting pins therein.

3. The mold as described in claim 1, wherein each of the inserts defines a through hole therein, with a locating pin extending through the through holes of the inserts thus joining the inserts together.

4. The mold as described in claim 1, further comprising a mold core, wherein the movable and fixed molds cooperatively define a chamber therein, and the mold core is inserted into the chamber, and wherein the mold core defines an opening therein, the insert group being received in the opening of the mold core.

5. The mold as described in claim 4, wherein the chamber is defined in the movable mold.

6. The mold as described in claim 4, wherein the insert group comprises a block, the mold core defines a carrier, and the block engages with the carrier of the insert group.

7. The mold as described in claim 4, wherein the at least a heat dissipation apparatus further comprises a housing of a centrifugal blower, the housing comprising a base wall and a sidewall surrounding the base wall, the mold core comprises a first portion having an essentially identical configuration to an outer surface of the sidewall, and a second portion having an essentially identical configuration to an inner surface of the sidewall, a first cavity being formed between a top surface of the first portion, an outer surface of the second portion and an inner surface of the chamber for forming the sidewall of the centrifugal blower, a second cavity being formed between the movable mold and the fixed mold for forming the base wall of the centrifugal blower.

8. The mold as described in claim 1, wherein the mold defines two mold cavities therein for simultaneously forming two heat dissipation apparatuses.

9. A mold for manufacturing at least a heat dissipation apparatus with a plurality of fins, comprising:

a movable mold;

a mold core; and a fixed mold covering the movable mold;

wherein one of the movable mold and the fixed mold comprises an insert group which comprises a plurality of separably stacked inserts, wherein a plurality of compartments are defined between adjacent inserts of the insert group for forming the fins of the at least a heat dissipation apparatus; and wherein the movable and fixed molds cooperatively define a chamber therein, and the mold core is inserted into the chamber, and wherein the mold core defines an opening therein, the insert group being received in the opening of the mold core.

10. The mold as described in claim 9, wherein the chamber is defined in the movable mold.

11. The mold as described in claim 9, wherein the insert group comprises a block, the mold core defines a carrier, and the block engages with the carrier of the insert group.

12. The mold as described in claim 9, wherein the at least a heat dissipation apparatus further comprises a housing of a centrifugal blower, the housing comprising a base wall and a sidewall surrounding the base wall, the mold core comprises a first portion having an essentially identical configuration to an outer surface of the sidewall, and a second portion having an essentially identical configuration to an inner surface of the sidewall, a first cavity being formed between a top surface of the first portion, an outer surface of the second portion and an inner surface of the chamber for forming the sidewall of the centrifugal blower, a second cavity being formed between the movable mold and the fixed mold for forming the base wall of the centrifugal blower.

13. The mold as described in claim 9, wherein each of the inserts defines a through hole therein, with a locating pin extending through the through holes of the inserts thus joining the inserts together.

14. The mold as described in claim 9, wherein the mold defines two mold cavities therein for simultaneously forming two heat dissipation apparatuses.

* * * * *